United States Patent [19]

Chrablow

[11] 4,188,872

[45] Feb. 19, 1980

[54] COMPACTOR

[75] Inventor: Marshall H. Chrablow, Mundelein, Ill.

[73] Assignee: Krossfield Inc., Mundelien, Ill.

[21] Appl. No.: 963,304

[22] Filed: Nov. 24, 1978

[51] Int. Cl.[2] ..... B30B 15/06

[52] U.S. Cl. ..... 100/53; 100/52; 100/100; 100/215; 100/226; 100/229 A; 100/233; 100/269 R; 100/295

[58] Field of Search ..... 53/529; 141/73, 80; 100/100, 229 A, 295, 53, 52, 226, 215, 233, 269 R

[56] References Cited

U.S. PATENT DOCUMENTS

| | | | |
|---|---|---|---|
| 2,720,160 | 10/1955 | Tice et al. | 100/245 |
| 3,113,506 | 12/1963 | Faeber | 100/295 X |
| 3,130,761 | 4/1964 | Fleming | 100/295 X |
| 3,838,635 | 10/1974 | Hardy | 100/229 A |
| 4,119,027 | 10/1978 | Elders | 100/229 A |
| 4,130,054 | 12/1978 | Tashman | 100/229 A |
| 4,147,100 | 4/1979 | Dykstra | 100/269 R |

*Primary Examiner*—Billy J. Wilhite

*Attorney, Agent, or Firm*—Rummler & Snow

[57] ABSTRACT

A modular refuse compactor having a shiftable rear compacting platen mounted at the lower end of an electro-hydraulic operated cylinder piston rod, and camming means to shift a folded front compacting platen from a vertical position to a horizontal position during downward movement of the rear platen and retain it in said horizontal position as an extension of said rear platen on the compacting cycle, and return it to the vertical position upon the retraction of the rear compacting platen, and appropriate cams and followers to effect such action.

8 Claims, 9 Drawing Figures

COMPACTOR

SUMMARY OF THE INVENTION

A refuse compactor of modular design, including a cabinet, having a fixed platen horizontally mounted on the lower end of a piston rod or ram of a hydraulic cylinder operable through an electro-hydraulic pump and a vertically disposed, foldable platen in non-operating cycle which cooperates with the fixed platen through followers and cams to move said foldable platen to the horizontal in alignment with the fixed platen on the operating compacting cycle, safety means cooperating with said foldable platen to prevent accidental entrapment of limbs by inadvertent insertion into the compactor housing and the refuse receiving door. Further objects will appear from the following detailed description.

DETAILED DESCRIPTION OF THE DRAWINGS

Figure 1:
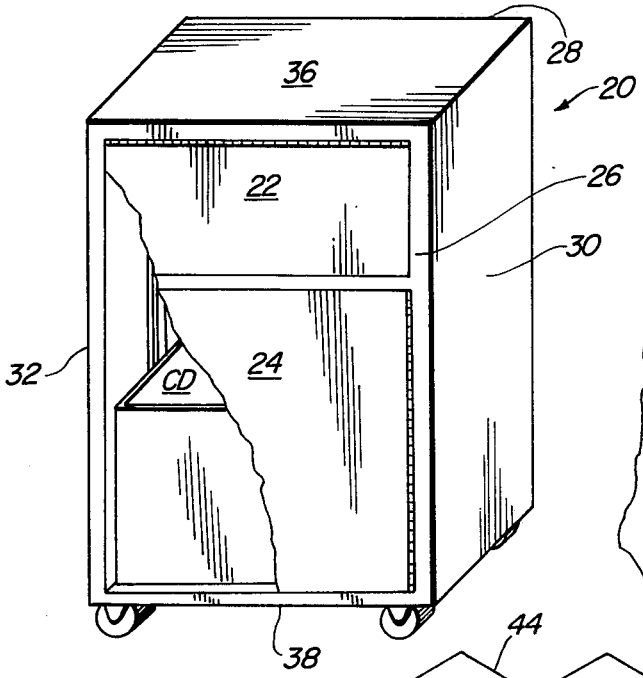
FIG. 1 is a perspective view of the compactor cabinet.

The words used herein, namely, forwardly, left or right movement, rear or rearwardly, upper or upwardly, down or downwardly and inwardly or outwardly, are directions as appear in the drawings.

The compactor shown in the drawings comprises a housing 20 having a patron refuse or trash receiving door 22 pivotally secured at its top end adjacent the upper end of the front panel 26 into which patrons normally place the used plates, cups, etc., all of which are expendable merchandise. The housing is provided with a plurality of horizontal and vertical right angle bars at the top, bottom and corners to which the front, back and side panels 26, 28 30 and 32 are secured in the ordinary manner. The unit is also provided with a top panel 36 and a bottom panel 38.

The entire compacting unit depends from a plate 40 having laterally extending side edges 42, 44 which are removably positioned adjacent the upper end of cabinet 20 on appropriate horizontally disposed angle irons.

Secured to the plate 40 and depending therefrom are stationary or non-movable side plates 50, 52. The hydraulic, elongated, vertical cylinder 56 is provided with a short rod 58 extending upwardly from the top of the cylinder for insertion through an elliptical slot 60 in the plate 40. The rod 58 is tied by a pin or bolt 62 so that the cylinder is positioned between the movable and stationary plates 50, 52 and 86, respectively. A spring washer 64 is positioned on said rod 58 between the top of the cylinder and the plate 40. Thus the cylinder 56 is free to pivot about five degrees from the vertical, as will be explained hereafter.

A combination motor 66 and hydraulic pump 68 is anchored to a mounting strap 70 and the strap is mounted to the stationary side plate 50 through rubber isolators 72 mounted on plates 74. The low voltage pump contains its own reservoir and shuttle valve interiorally thereof and not shown in the drawings as they form no part of the present invention.

The cylinder 56 is provided with the usual piston (not shown) positioned in the cylinder in the usual manner having a depending piston rod or ram rod 76 secured to the piston, also in the usual manner. The lower end of the piston rod 76 is welded to a transverse pusher rod 78 medially of its ends. The ends of rod 78 extend through cam slots 82 in the lower ends of each of the opposed spaced movable plates 86 and slightly outwardly thereof.

A rear platen or compactor plate 84 is anchored to the lower ends of the pair of opposed spaced, movable plates 86. The plates 86 are provided with sidewardly and outwardly extending right angled flanges 88 on their side edges. The plates with their flanges slidably shift vertically between the inwardly extending flanges 90 of the stationary plates 50, 52 sliding adjacent and against the inner side of the flanges 90. The flanges may be covered with a Nylon of Teflon covering for easy sliding movement.

The front or folding platen or compacting plate 92 is provided with a channel bracket 94 welded to the upper surface thereof medially of the side edges thereof. (See FIG. 3.) The bracket 94 is provided with a pair of upstanding flanges or side walls 96, 98 each having spaced perforations 100, 102 adjacent the top edges thereof to receive pivot rods 104, 106, respectively. A pair of spaced arms 108, 110 are secured, by welding, to the upper surface of the platen 84 and each arm is provided with perforations to receive the rod 104. Thus the front platen 92 will pivot on rod 104. The rod 104 is provided with means on its end to prevent it from shifting laterally, but not shown in the drawings as any of the usual means may be employed.

The ends of rod 112 extend through and are adapted to ride in opposed angular cam slots 114 in the plates 86. The slots 114 lie above and rearwardly of slots 82 and have the same angular configuration as slots 82 except each of the slots 114 is provided with reverse right angle bend 116 at the lower ends thereof extending downwardly and rearwardly. The purpose thereof will hereinafter be described.

Figure 5:
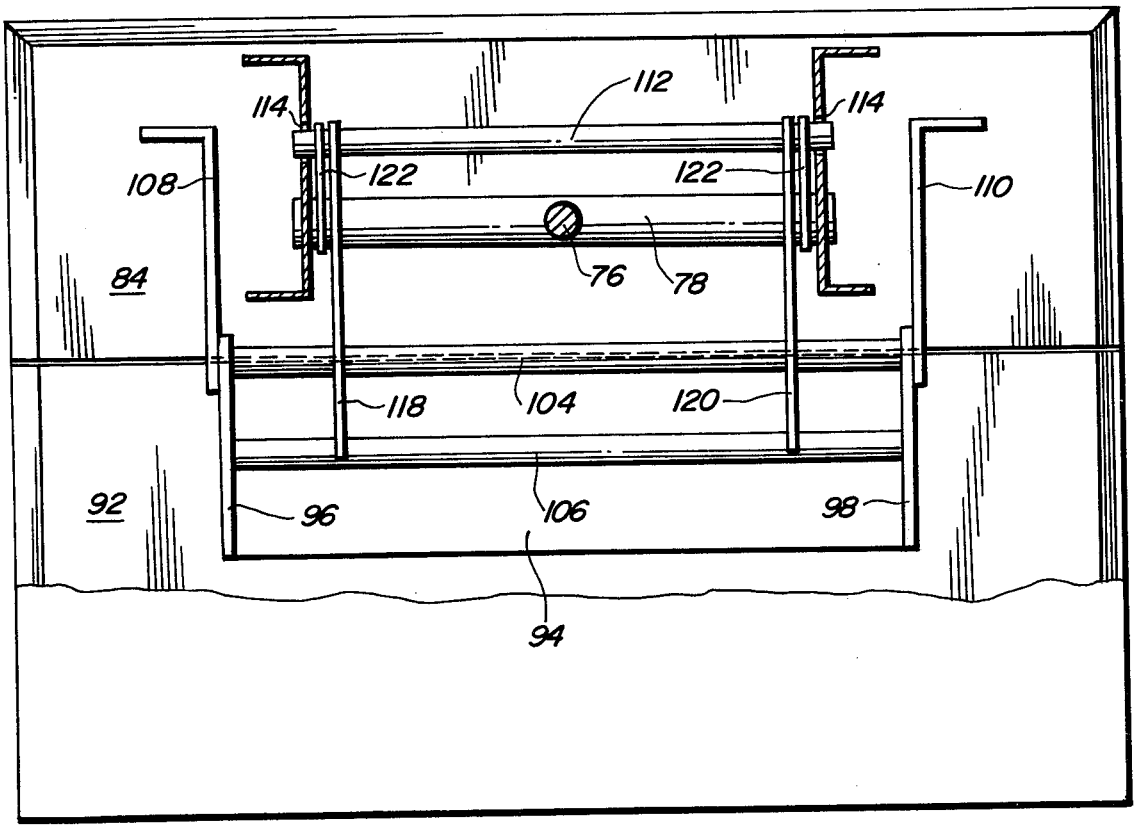
FIG. 5 is a cross-sectional view taken on the lines 5—5 of FIG. 4 with parts broken away.
Figure 7:
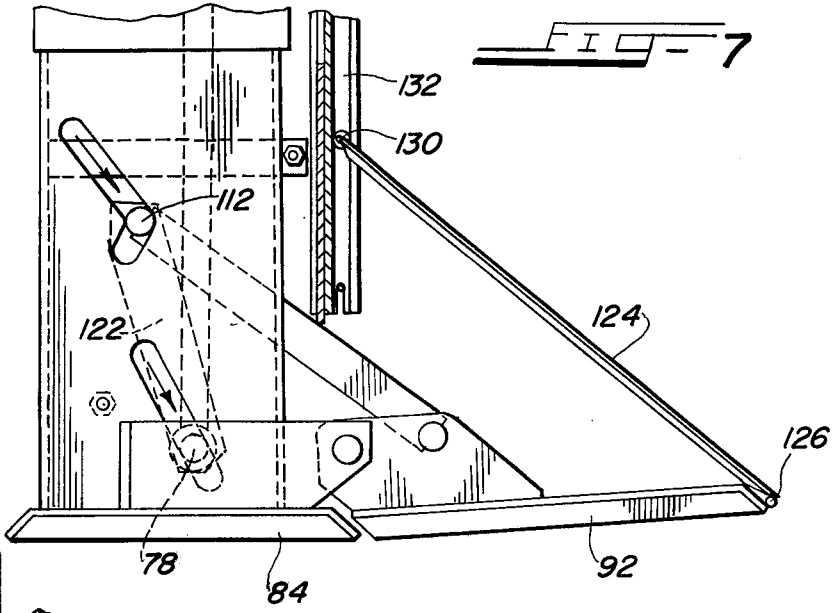
FIG. 7 is a view similar to FIG. 6 but showing movable and fixed platen in partial fully operative position.
Figure 8:
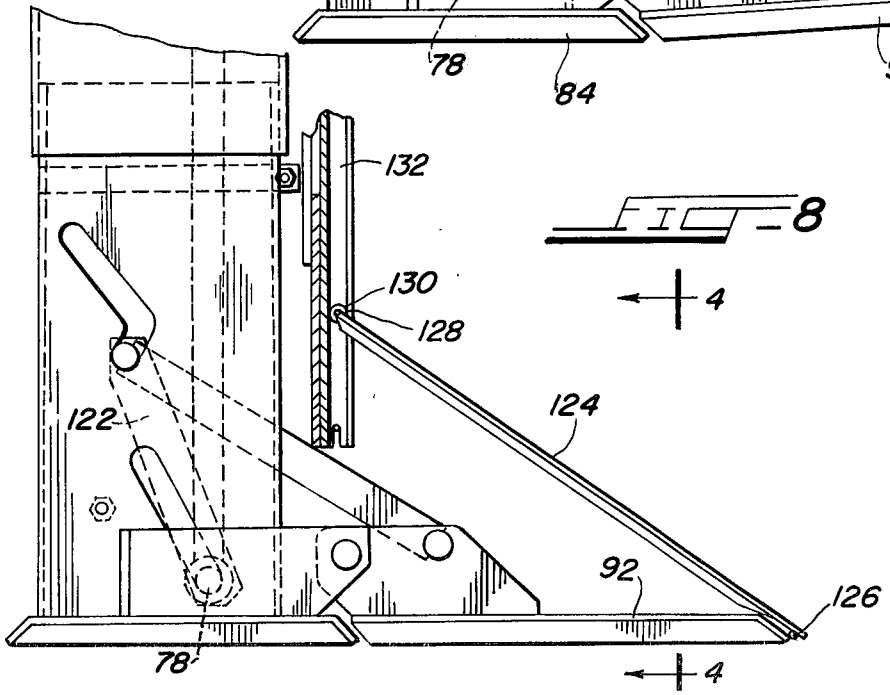
FIG. 8 is a view similar to FIGS. 6 and 7 but showing the platens in fully operative position.

Each of the rods 106 and 112 are connected together by spaced, pivoting arms 118, 120, which arms are secured to the respective rods, as shown in FIG. 5. Also, coordinating, captive plates 122 having perforations in their ends also are placed on and between rods 106 and 112 and positioned respectively between the inner walls of the movable plates 86 and the respective arms 118, 120 whereby as the rod 78 is shifted upwardly or downwardly by the ram rod 76, the plates 122 capture this movement and shift the rod 112 in its slot 114 either to draw the front platen 92 to a vertical position on upward movement of the rod 76 or shift it to the horizontal position on the downward movement of the rod 76, all as shown in FIGS. 6, 7 and 8.

Figure 2:
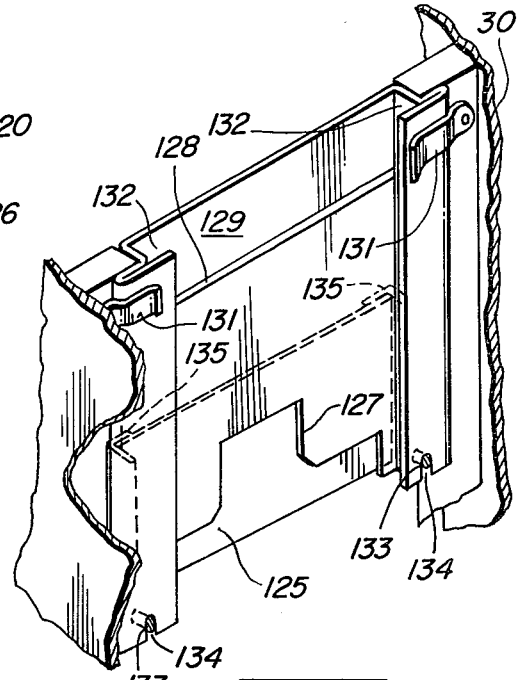
FIG. 2 is a perspective view of the guard plate in front of the compactor mechanism for supporting the safety plate on which it travels, and with parts broken away.

Secured to the free edge of the front platen 92 by a piano hinge 126 is a protector plate 124. The free or opposed end of the plate 124 is provided with rod 128 having Nylon glides or rollers 130 on its ends laterally of the plate 124 for sliding in grooves 132 in the compactor mechanism cover plate 129. This plate 129 is secured to the side walls 30, 32 by finger controlled latches 131 and maintained therein by rods 133 lying in slots 134. The rods 133 are U-shaped with the ends secured to the walls 30, 32, respectively. See FIG. 2. Thus, as the front platen 92 shifts up or down, so does the protective plate 124 to prevent injury to arms and hands if unauthorizedly inserted in the interior of the cabinet 20 through receptacle door 22. See FIGS. 6, 7 and 8. The protector plate 124 will be angularly positioned in its movements at all times to prevent a person from reaching the movable mechanism and thus prevent accidents.

It is to be noted that a gravity shiftable door 125 covers opening 127 in plate 129. The door slides against the rear face of the plate 129 and is loosely held thereagainst by angle irons 135 welded to the rear face of plate 129. This door will move upwardly by abutting the upper edges of arms 118, 120 on the upward or downward movement of movable platen 92.

Figure 6:
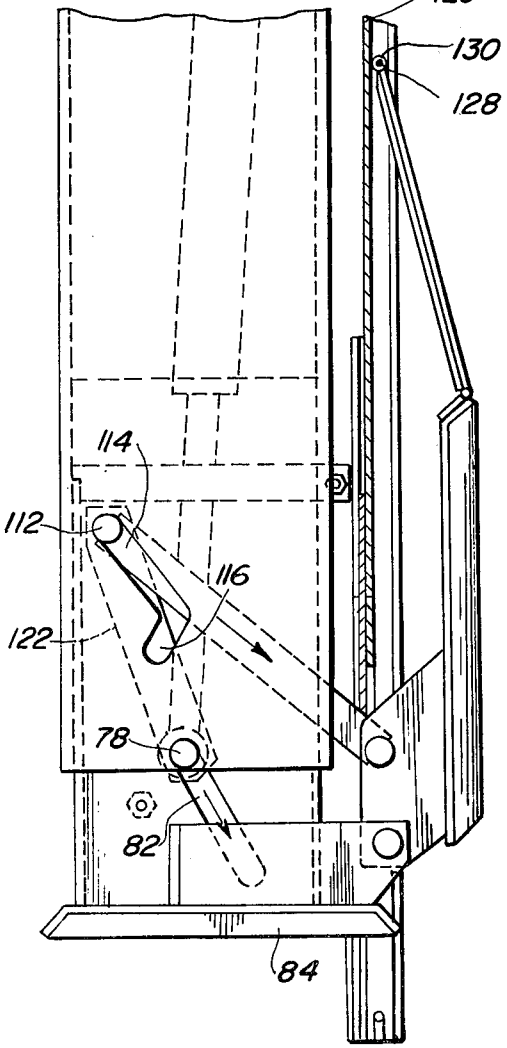
FIG. 6 is a side elevational view, with parts broken away for clarity, showing the relationship of the movable platen and the safety plate and foldable platen in inoperative position and showing the guide slots and pins.

FIG. 6 shows the piston rod in its up or rest position. Thus the front platen is in a vertical position, as is the protective plate 125 and the sliding plates 86. The rods 104 and 106 are positioned at the upper end of the cam slots 82, 114. It is to be noted the ram rod 76 is canted in rest or nonoperative position.

FIG. 7 shows the piston rod 76 moved almost through its down stroke with rods 78, 112 near the lower ends of the cam slots 82, 114. The front platen 92 is not quite horizontally disposed.

FIG. 8 shows the two platens 84 and 92 lying in a horizontal plane with the fixed or rear platen 84 at the bottom of its stroke. It is noted the rod 78 is at the lowermost position, is bottomed in the lower end of cam slot 82 and the ram rod 76 is in vertical position. The rod 112 is also bottomed in the lower end of the right angled slot 116 and will not move from there because of the rod 78 being fixed to the piston rod and also because of the plates 122 which are shifted by the movement of the rod 78. Thus both platens are in compacting position.

On the downward stroke of the piston rod from rest position (see FIG. 6), the folding or front platen begins its outward and downward movement thereby sweeping all refuse not already in the container drawer CD, positioned in the lower end of the cabinet 20, therein on its downward arcuate travel for compaction.

Figure 9:
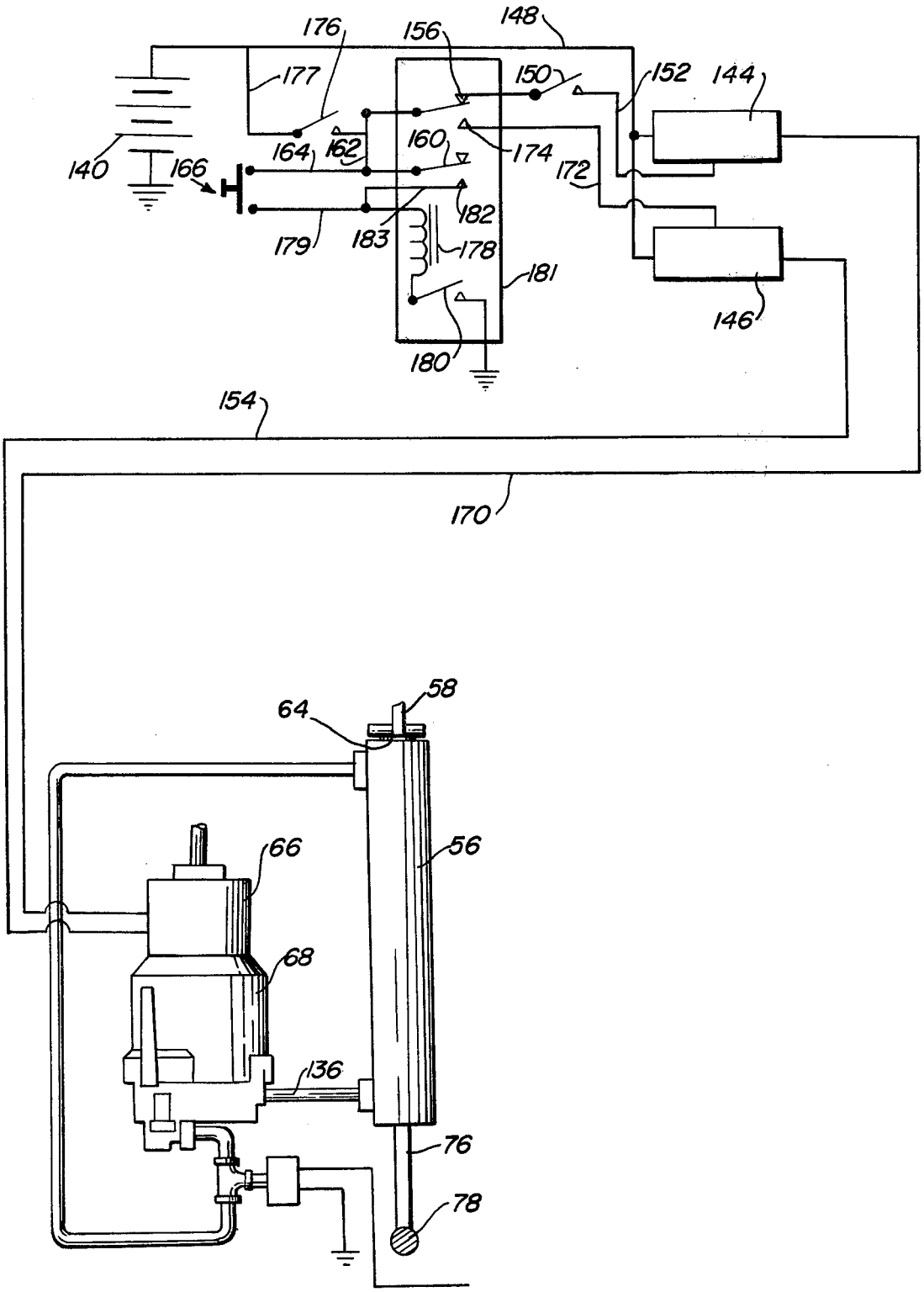
FIG. 9 is a schematic circuit diagram and including the cylinder pump, motor and cylinder all connected together.

Referring to FIG. 9, in the device shown in the drawing, hydraulic pump 68 is directly connected to the lower end of the cylinder 54 by fluid conduit 136 and through feed conduit 138 to the upper end of cylinder 56.

A 12-volt battery 140 is positioned in the upper end of the cabinet and on a mounting 142 connected to the plate 52.

The circuit of FIG. 9 is shown in inoperative position wherein the positive side of the battery 140 is connected to the relays 144, 146 by lead 148. The relays 144, 146 are of the usual automobile type but silicone controlled rectifiers may be substituted. The relay 144 controls the upward movement of the piston rod and the relay 146 controls the downward movement thereof. The relay 144 is also connected to the contact on the open side of switch 150 via wire 152 while the other side of the relay 144 is connected to the motor via wire 154. The upper limit switch 150 is connected to the contact 156 on the normally closed switch 158. Switch 158 is also connected to a normally closed switch 160 via wire 162 and through wire 164 to one side of pushbutton or keylock switch 166 which operates the motor.

The down relay for energizing of the motor 66 is connected to said motor by wire 170. The opposite end of the relay is connected to the positive side of battery 140 through wire 148. A third wire 172 form the down relay is connected to the normally open contact 174 of switch 158. A key locking switch 176 is connected between the battery 140 and wire 162 via wire 177. This switch 176 controls the entire circuit and must be closed before the circuit is operable.

The other side of the pushbutton switch 166 is connected to a solenoid 178 via wire 179. The solenoid 178 is also connected to the normally open pressure switch 180 and the switch 180 is grounded. The open contact 182 of switch 160 is connected to wire 179 via wire 183 to the pushbutton switch 166. Thus the symbols in box 181 is a double pole, double throw relay switch.

Thus the hydraulic pump drives the hydraulic cylinder piston rod downwards or upwards on command from a simple logic circuit consisting of relays and switches.

The low current logic circuit is designed so that when a compactor cycle is initiated by closure of key locking switch 176 and the closure of the pusbutton switch 166, the double pole, double throw relay will latch switches 158, 160 on contacts 174, 182 to cause the current to flow to the down relay 146 to energize the motor, thus energizing the pump 56 causing the piston rod to move the platens downwardly, to a point where the pressure sensitive switch 180 is closed because the platens reach bottom or exert substantial pressure against the load in the refuse bin positioned in the lower portion of the container 20.

Closure of the pressure switch will de-energize the solenoid 178 causing the switch to unlatch and return to the position shown in circuit drawing FIG. 9, thus energizing relay 144 to cause the pump 66 to reverse its fluid pathway. As the piston rod and appendages return to storage position, it strikes the upper limit switch 158 and the unit is at rest.

Figure 3:
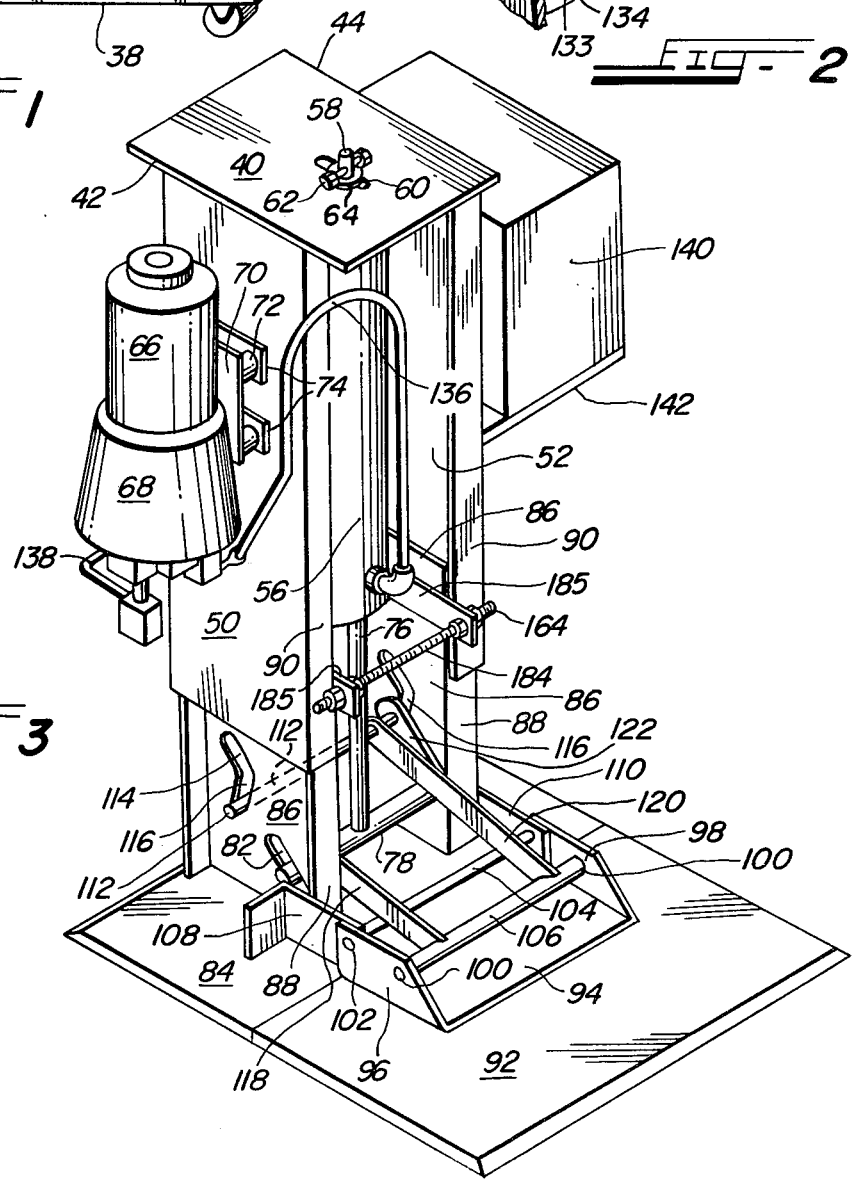
FIG. 3 is a perspective view of the interior working mechanism showing the device in operating position with parts broken away.
Figure 4:
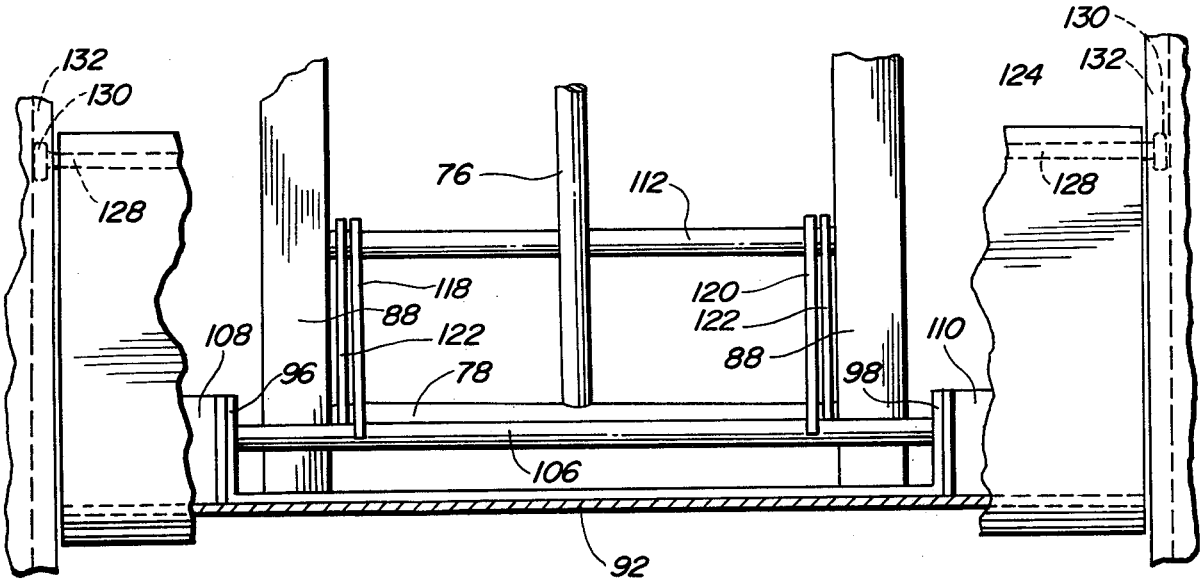
FIG. 4 is a front elevational view, with parts broken away and in partial cross-section, taken on the lines 4—4 of FIG. 8.

To effect proper distance between the movable plates 86 and the stationary plates 50, 52, a pair of adjustable, threaded rods 184 are positioned one on each of the inner sides of the movable plates, as shown in FIG. 3. One rod is only shown in the drawings as the other rod is on the opposed side of the movable platens and cannot be seen in the drawings. The rods are positioned in apertures in brackets 185 which are welded to the inner side of the movable plates 86. Nuts are threaded on each rod on each side of the bracket to make the appropriate adjustment for easy shiftability of the moving plates with respect to the stationary plates.

The compactor unit is readily insertable in the usual trash receptacle found in fast food chains by very minor modification of the receptacles.

Also, the usual interlock switches are incorporated in the device to disconnect all operations when improper usages occur.

It will be understood that although the device shown and described herein is directed to a low voltage compactor, the device can also be operated by normal house current. A simple change in the circuitry and a few additional adjustments are all that is required.

Although but one specific embodiment of this invention is herein shown and described, it will be understood that details of the construction shown may be altered or omitted without departing from the spirit of the invention as defined by the following claims.

I claim:

1. In a compactor, a pair of downwardly movable compacting platens hingedly secured together end-to-end, means to position one platen vertically in noncompacting position and shift it to the horizontal position in compacting positions, means to lock said one platen in compacting position, and means to actuate said platens.

2. In a compactor comprising a housing, a cylinder in said housing, a ramrod extendible and operable from said cylinder, means to operate said cylinder, a pair of spaced stationary plates one positioned on each side and spaced from said cylinder, a pair of spaced vertically movable plates positioned between and cooperating with said stationary plates, a horizontally disposed, fixed platen anchored to the lower ends of said movable plates, a foldable platen pivotally secured to an end of said stationary platen and lying in a vertical position during noncompacting cycle, whereby upon actuation of said ramrod by said cylinder, it will shift said stationary platen to compactive position and means to simultaneously shift said foldable platen to a horizontal position as an extension of said stationary platen during compacting cycle.

3. The device according to claim 2 wherein the movable plates are each provided with pairs of upper and lower cam slots, a pusher rod secured medially to the free end of said ramrod and positioned transversely to the axis of said ramrod, the free ends of said pusher rod seated in a pair of spaced cam slots in said movable plates.

4. The device according to claim 3 wherein a pivot rod is secured to said movable platen and said foldable platen and said platen is anchored to said movable platen and pivotally secured in end-to-end relationship thereto, the opposite ends of a movable rod seated in a second pair of cam slots in said movable plates positioned above said first mentioned cam slots, a pair of spaced arms pivotally secured to said rod and said movable rod, and a pair of captive plates each pivotally secured to said pusher and movable rods each adjacent said movable plates, whereby movement of said pusher rod will be translated to said movable rod to raise or lower said foldable platen.

5. The device according to claim 4 wherein the cam slots extend downwardly and forwardly at about a thirty degree angle, and said upper slot is provided with a right angle bend at its lower end, whereby to anchor and retain said second rod in compacting position.

6. The device according to claim 2 wherein the movable plates are held spaced apart by adjusting bolts.

7. The device according the claim 2 wherein a rectangular plate supports all the compacting mechanism and said cylinder is pivotally secured at its upper end to said plate.

8. In a device according the claim 2 wherein said housing has a pair of side walls, a cover plate having latch means to removably secure said cover plate to said side walls, said cover plate covering said compacting mechanism, a safety plate pivotally secured at one end to the free end of said foldable platen, the opposite end of said safety plate slidably anchored in said cover plate and shiftable when said movable compacting platen shifts.

* * * * *